US005412893A

United States Patent [19]

Aiken, Sr.

[11] Patent Number: 5,412,893

[45] Date of Patent: May 9, 1995

[54] MANUALLY OPERABLE SCROLLING WEB SIGN

[75] Inventor: Robert B. Aiken, Sr., Grafton, Wis.

[73] Assignee: Milwaukee Sign Co., Inc., Grafton, Wis.

[21] Appl. No.: 927,454

[22] Filed: Aug. 10, 1992

[51] Int. Cl.[6] ..... G09F 11/18

[52] U.S. Cl. ..... 40/518; 40/573

[58] Field of Search ..... 40/518, 519, 471, 522, 40/523, 572, 573, 308

[56] References Cited

U.S. PATENT DOCUMENTS

| | | | |
|---|---|---|---|
| 1,107,125 | 8/1914 | Walker | 40/518 |
| 1,872,145 | 8/1932 | Hurford | 40/522 |
| 3,255,541 | 6/1966 | Bettcher | 40/518 X |
| 3,582,937 | 6/1971 | Dozer | 40/471 X |
| 4,104,810 | 8/1978 | Mirman | 40/518 X |
| 4,327,513 | 5/1982 | de Gunzburg | 40/572 |
| 4,680,883 | 7/1987 | Stadjuhar | 40/518 X |
| 4,741,118 | 5/1988 | Aiken et al. | 40/518 |
| 4,930,795 | 6/1990 | Tannehill et al. | 40/308 X |
| 4,995,183 | 2/1991 | Aiken | 40/518 |
| 5,016,371 | 5/1991 | Aiken | 40/518 |
| 5,088,219 | 2/1992 | Toraby-Payhan | 40/471 |

*Primary Examiner*—Kenneth J. Dorner
*Assistant Examiner*—J. Silbermann
*Attorney, Agent, or Firm*—Andrus, Sceales, Starke & Sawall

[57] ABSTRACT

A scrolling sign includes a plurality of webs each having indicia which is displayed through a window on a sign face. The webs are disposed in alignment with one another. A switch controls a clutch associated with each of the scrolling webs for selectively connecting a manual crank mechanism with one of the scrolling webs.

14 Claims, 6 Drawing Sheets

OFF
1
2
3
26
14
40
38
12
124
184
94
106
90
104
92
96
66
62
72
34
68
186
54
43
77
44
45
46
42
154
33
86
76
74
88
84
82
80
101
30
93
103
107
91
150
152
181
183
164
130
98
105
27
100
31
28
3
4
18
120
20
21
22

FIG. 9
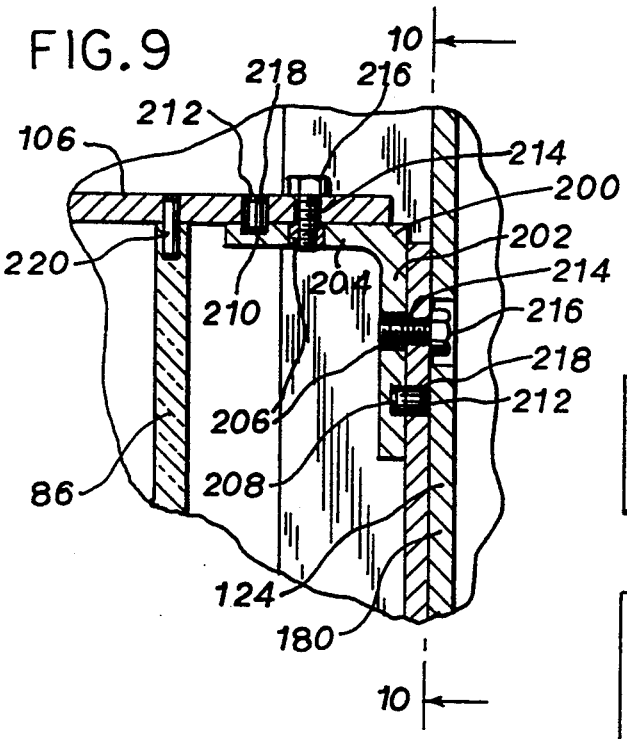
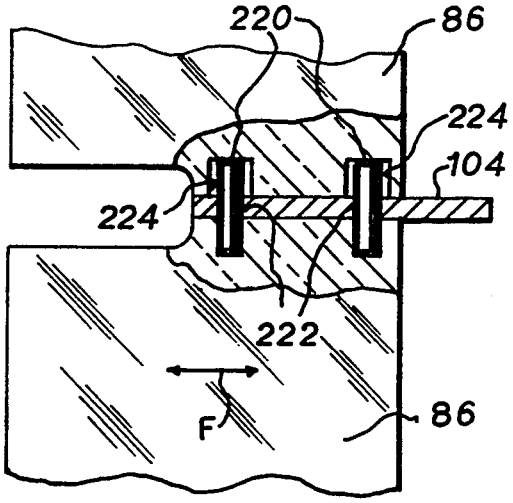
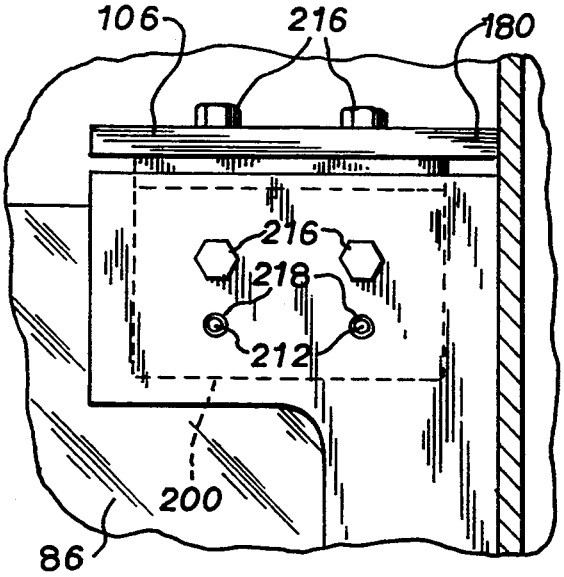
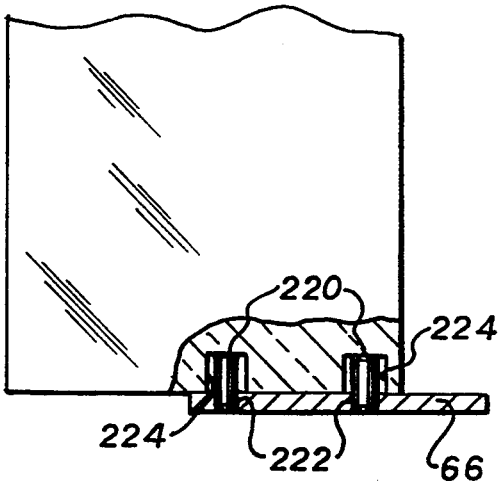
FIG. 11
FIG. 10

MANUALLY OPERABLE SCROLLING WEB SIGN

BACKGROUND OF THE INVENTION

1. Field of the Invention

The subject invention relates to a sign of the type in which indicia are changed by scrolling a web containing the indicia across one or more viewing windows in the sign. The invention is specifically directed to a mechanism for mechanically scrolling a plurality of different indicia webs by use of a manual scrolling actuator.

2. Description of the Prior Art

Scrolling signs are known in the art. They are particularly useful for gasoline service stations and the like where information about a wide range of products is displayed on the signs. It is often necessary or desirable to change the information displayed due to competitive factors, seasonal considerations, special promotions, or numerous other reasons. Motor fuels, such as gasoline, are typical of the product for which information, such as pricing, changes frequently. The price of gasoline is typically advertised to the consumer by signage located on the premises of the service station. The signs are usually close to the road and thus remote from the office or payment booth. They are usually elevated to increase their visibility to passing motorists. Such signs are often backlighted for the same reasons, as well as to emphasize brand names and other consumer information. All of these factors raise problems with respect to changing pricing information.

The changing of pricing or other information by exchanging placards on the sign is at best cumbersome, and because of environmental damage and vandalism, somewhat undesirable. These problems led to the development and use of electrically changeable signs wherein the letters are formed from a matrix having incandescent lightbulbs, liquid crystal or light emitting diode elements or magnetic flippers. However, the use of such matrices often lessens or destroys the graphic features or aesthetics of the sign. Colors, fonts or other design features of the changeable indicia are usually severely limited.

Over the years, a number of scrolling web signs have been developed which permit the use of enhanced graphics, meet the needs of providing protected indicia and are readily changeable. These provide a very desirable, aesthetically pleasing signage for billboards and other use in which the indicia of the sign have to change from time to time.

Scrolling web signs include indicia which may be changed, yet still be protected from the environment with a protective transparent cover sheet, and are an improvement over signs of the type wherein the letters are generally removable from the ground position by use of elongated poles and the like for hanging the letters on positions provided in the sign. The scrolling signs are also more aesthetically pleasing than the matrix type signs, permitting a wider range of graphics to be used. The covered indicia of the scrolling web signs are less susceptible to soiling, wind damage and vandalism. All of these factors make the scrolling web sign preferable over many of the signs of the prior art in providing signage where the indicia must be changeable.

Examples of such signs are seen in U.S. Pat. No. 4,741,118 entitled "Sign With Improved Scrolling Mechanism," issued to R. Aiken, et al on May 3, 1988 and U.S. Pat. No. 4,995,183 entitled "Scrolling Sign With Improved Web Guide," issued to R. Aiken on Feb. 26, 1991. U.S. Pat. No. 4,741,118 discloses a scrolling sign having a sign face with windows in which indicia may appear. A pair of shafts are mounted in the framework of the sign for containing a plurality of web rolls between which webs containing indicia extend. A drive mechanism, including an electric motor, simultaneously rotates the shafts. Clutches interposed between the web rolls and the shafts are selectively operable to move the webs in one or the other direction across the window to alter displayed indicia. A constantly applied differential brake is also coupled to the web rolls to maintain tension on the webs and to assist in their movement. The control for the motor and clutches may be placed at a position remote from the sign and cabled to the sign.

SUMMARY OF THE INVENTION

While the electric scrolling web signs of the prior art type have been widely accepted, a need has also developed for a manual scrolling price sign which has the same aesthetic qualities and versatility as the electric powered scrolling web signs currently available but which is lower cost in construction and installation.

The subject invention is directed to a mechanical scrolling web sign wherein indicia, such as pricing, on the sign can be changed by use of a hand crank. The price changes can be completed in a minimum amount of time and with a minimum effort. The manual scrolling web sign allows price changes on demand by coupling the crank to the sign and manually scrolling the numerals to the desired price.

The mechanical scrolling web sign may incorporate a plurality of indicia webs. The indicia webs can be arranged in horizontal or vertical alignment with one another. A clutch control mechanism, which operates on the power available for illuminating the sign, is operator controlled for selectively driving any one of a plurality of webs. The control box for the clutch mechanism can be mounted directly on the sign and, in the preferred embodiment, is key operated to prevent tampering. The crank mechanism may be held by the operator at ground level and inserted in drive apertures located in or adjacent the frame of the sign for scrolling one or more of the indicia webs and in a desired order for changing the prices of products advertised on the sign.

The manual scrolling web sign of the present invention is particularly well suited in installations where remote electrical cable controlled systems are impractical. It is particularly efficient for upgrading existing signage at service stations and the like.

The manual scrolling web sign of the subject invention is designed to be easy to use and requires only that an operator be able to select one of several positions on a switch, insert the crank actuator in the proper drive aperture in the sign and turn it until the proper indicia is displayed. It eliminates the need for the arm changers, ladders or lifts previously required for manually changing the indicia and further minimizes the risk of wind or other environmental conditions damaging the indicia or the risk of vandalism, such as removing or altering the indicia.

By using the scrolling web sign of the subject invention, an even, shadowless backlighting can be used or where desired, recessed lighting may be employed. Full face illumination provides better visibility and improved aesthetics and meets modern advertising needs. The illumination properties of the sign can be reversed if desired, providing lighted indicia on an opaque background.

In the preferred embodiment, the entire scrolling mechanism is modular and the scrolling mechanism swings out or is removable for easy access to lamps and for servicing of the sign. All of the indicia are within an enclosed surface and are protected from soiling and environmental damage.

It is, therefore, an object of the present invention to provide an improved scrolling web sign permitting manual operation of the sign.

It is a further object of the present invention to provide a manual scrolling web sign wherein a plurality of scrolling webs may be placed in alignment with one another and selectively operated by a single crank mechanism.

It is yet another object and feature of the present invention to provide a scrolling web sign wherein the indicia on the web may be enclosed with respect to the environment by a cover panel which defines a window through which the indicia is displayed.

It is yet another object and feature of the present invention to provide for a scrolling web sign with easy access to illumination devices and sign mechanics.

The foregoing and other objects will be more fully understood from the following drawings and detailed description of the invention.

BRIEF DESCRIPTION OF THE DRAWINGS

FIG. 9 is an enlarged fragmentary view looking generally in the same direction as FIG. 2.

FIG. 10 is a section view taken generally along the line 10—10 of FIG. 9.

FIG. 11 is an enlarged fragmentary view, partially in section, looking generally in the same direction as FIG. 10.

DETAILED DESCRIPTION OF THE PREFERRED EMBODIMENT

Figure 1:
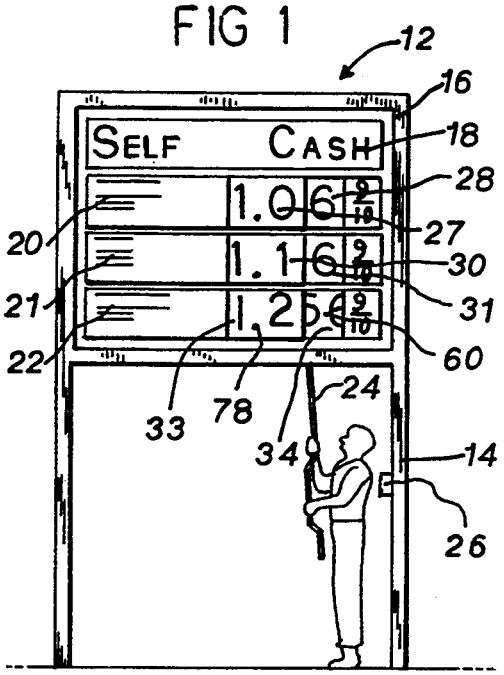
FIG. 1 is an illustration of a manual scrolling sign incorporating the features of the subject invention.

The manual scrolling sign 12 of the subject invention is shown in FIG. 1. As there shown, the sign is particularly well suited for a gas station price sign and may be placed on a stand-alone permanently installed support 14 or may be used with a logo-type sign in combination with a price sign in the manner well known in the industry. The sign 16 is designed to be fully illuminated and provides a large, easy to read information panel 18 and a plurality of product panels 20, 21 and 22, where various products offered at the service center are identified. For example, the panel 20 may identify unleaded regular gasoline, the panel 21 unleaded midgrade gasoline, and the panel 22 premium unleaded gasoline. In the preferred embodiment, the sign face is translucent and is back lighted.

When the sign is viewed as in FIG. 1, there are additional panels immediately adjacent each of the product identification panels 20, 21 and 22. In the preferred embodiment of the invention, these panels are windows through which pricing indicia are exposed, as shown in FIG. 1. In the embodiment illustrated in FIG. 1, the price indicia panel windows 27 and 28 are associated with the upper product indicia panel 20. The price indicia windows 30 and 31 are associated with the product indicia window 21. The price indicia windows 33 and 34 are associated with the product indicia window 22.

In one embodiment of the subject invention, the pricing indicia may be selectively changed by inserting a hand crank actuator 24 in an aperture provided in, or adjacent, the bottom of the sign and manually turning the hand crank until the desired price appears in one or more indicia panel windows. It will be understood that placement of the crank aperture is a matter of choice. A control 26 is mounted remote from the sign panel 16 and may be placed directly on the support 14 or at a remote location as desired. By using the control to select the web associated with the respective panel 20, 21 and 22, and then turning the crank 24, the appropriate price indicia may be altered to the selected amount in the corresponding indicia window of the sign.

In the illustrated embodiment in which the price is expressed in decimal format, the "tenths" indicia are permanently set as 9/10ths on the face of the sign. The "cents" webs in windows 28, 31 and 34 are adjustable to any digit between zero and nine and a blank and the remaining "dollar" webs in windows 27, 30 and 33 include both the dollar and ten cent price figure, as well as a blank. To change the price indicia in any of the windows 27, 28, 30, 31, 33 or 34, the hand crank actuator 24 is inserted in the appropriate aperture in the sign and the desired web position is selected on the control 26 (FIG. 6).

It will be appreciated that by appropriate modification, information can also be displayed in a nondecimal format. It may also be desirable to include other informational indicia or a blank section on each web to indicate when an item is not for sale, or other messages.

Figures 2, 6:
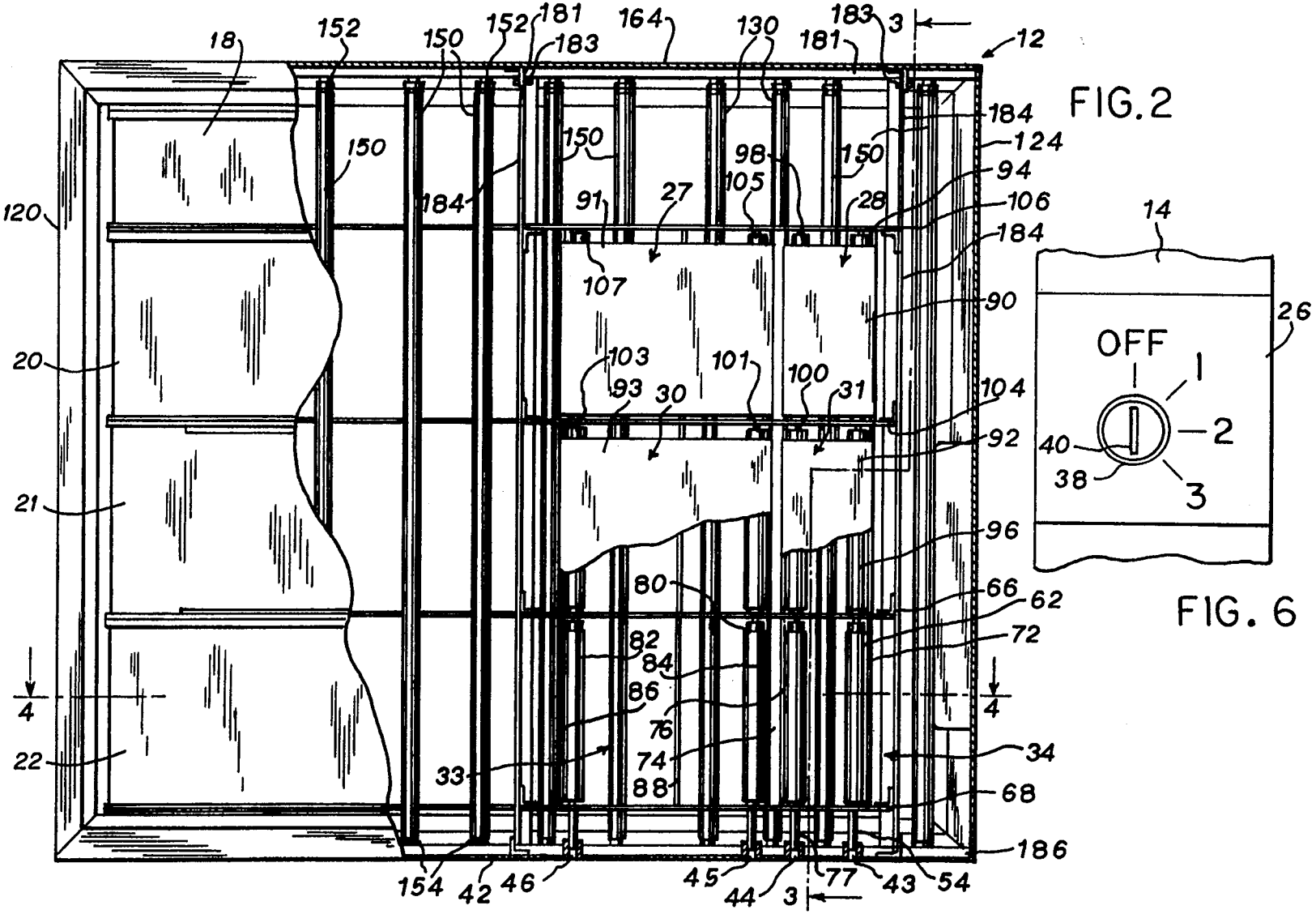
FIG. 2 is a front elevation of the sign of FIG. 1, partially in section, illustrating the scrolling mechanism and illuminating equipment of the subject invention.
FIG. 6 is an elevation view of a control for the subject invention.

As shown in FIG. 6, the control 26 of the preferred embodiment includes a switch 38 which is selectively rotatable to any of one of four positions. The switch may be key operated, or other means for security, such as a locking cover for the switch may be provided. For a key operated switch, a key slot 40 is provided in the switch and is adapted to receive a mated key for unlocking the rotating switch mechanism 38. In FIG. 6, the switch 38 is shown in the locked or "OFF" position. When rotated to the position where the slot 40 is aligned with the numeral "1", the mechanism activates the drive mechanism for changing the price indicia in either of the windows 27 or 28. When the switch is rotated to the position in alignment with numeral "2", the mechanism is activated for changing the indicia in either of the windows 30 or 31. When the switch is rotated to the position in alignment with numeral "3", the mechanism is activated for altering the indicia on either windows 33 or 34.

In the preferred embodiment, a clutch mechanism is controlled by the control 26, wherein the movement of the switch mechanism to the selected position activates a one-way clutch to engage the drive mechanism associated with the respective indicia containing web. The drive mechanism may also include a differential brake for maintaining proper tension on the web. A typical clutch and brake mechanism is shown and described in U.S. Pat. No. 4,741,118 entitled: "Sign With Improved Scrolling Mechanism," issued to R. B. Aiken, et al, on May 3, 1988. U.S. Pat. No. 4,741,118 is incorporated by reference herein. It will be understood that in the illustrated embodiment, the clutch is operative such that all of the web rolls in a given horizontal array are engaged when the switch mechanism is properly positioned, but the only functioning clutch is that clutch in association with the drive shaft engaged by the crank 24. Thus, only one web is movable at any one time, the switch mechanism activating a vertical position and the crank activating a horizontal position in the embodiment shown and described.

Figure 5:
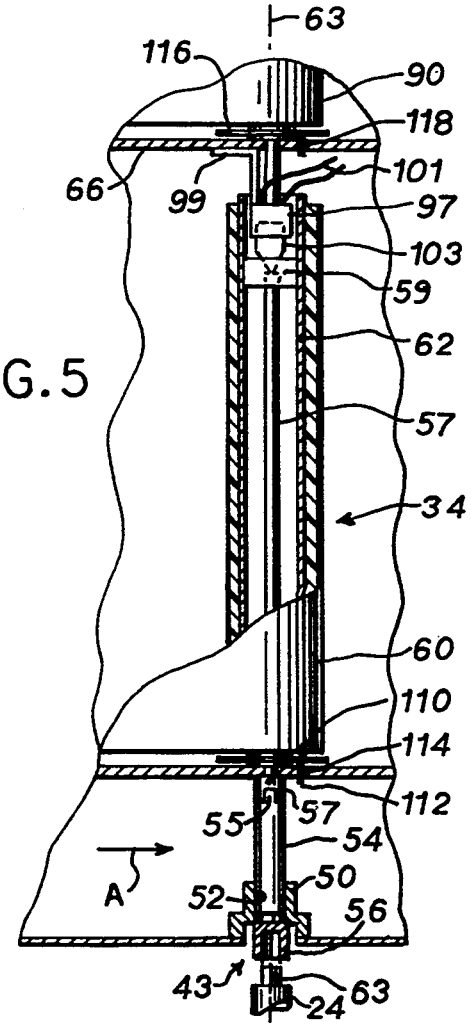
FIG. 5 is an enlarged fragmentary view looking generally in the same direction as FIG. 3.
Figure 15:
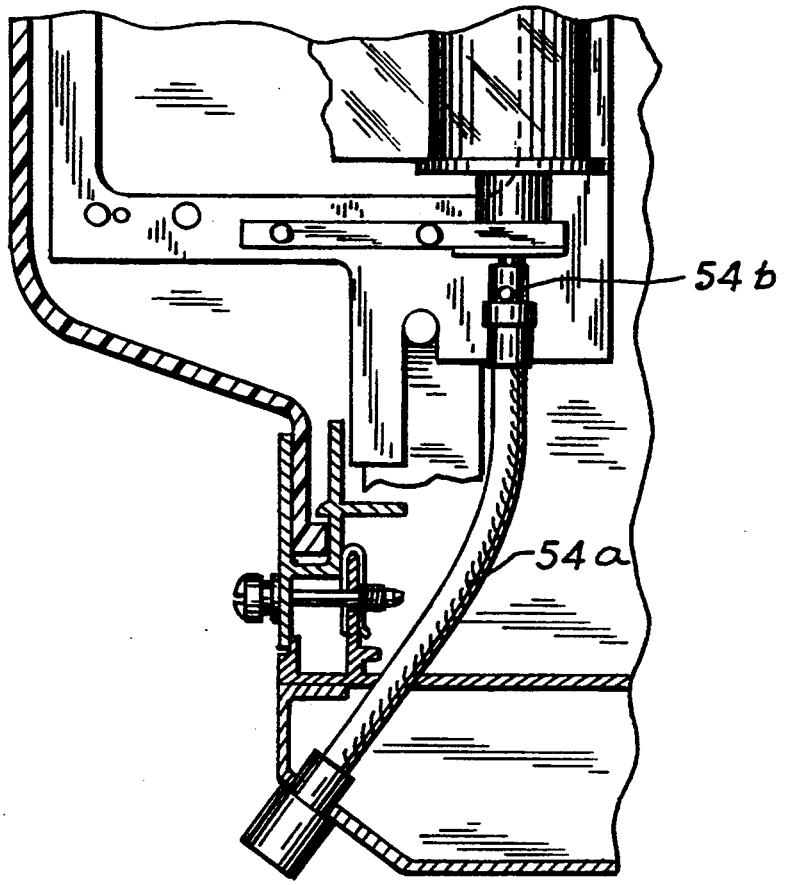
FIG. 15 is a fragmentary view of a portion of FIG. 13.

As shown in FIG. 2, the bottom wall or base 42 of the sign 12 includes a plurality of through apertures 43, 44, 45 and 46, each adapted for receiving the end of the hand crank 24. As is best seen in the enlargement of FIG. 5, illustrating aperture 43, each aperture includes an elongated sleeve 50 having a smooth cylindrical interior wall 52 for journaling the drive shaft end 54 for the scrolling drive mechanisms. The lowermost end of the shaft 54 includes a socket 56 adapted for receiving a complementary drive member on the end of the crank actuator 24 (FIG. 1). Drive shaft 54 could also be made of flexible shafting 54*a* shown in FIG. 15 allowing the placement of the crank apertures in positions other than directly below with rolls or spindles. This permits additional signage to be placed directly below sign 12, if desired. Flexible shafting 12*a* may be pinned by pin 54*b* to the lower end of the drive shaft for the rolls and spindles. This permits flexible shafting 54*a* to be disconnected.

When the crank 24 is inserted in the opening 43 and the drive member engages the socket, the crank and shaft 54 may be rotated in the appropriate direction, for scrolling the price indicia or the selected web past the selected window until the appropriate price figure is exposed.

For descriptive purposes, it will be assumed that the hand crank actuator 24 is in driving engagement with the shaft 54 associated with the aperture 43 and that the control switch mechanism 38 is in alignment with the numeral "3" position for controlling the price indicia webs associated with the windows 33 and 34. When the mechanism is activated in this manner, the crank 24 will be operative for changing the "cents" indicia in window 34 to any selected digit from a nine to a zero in a given order, such as descending, by rotating the indicia past the window from left to right (as shown in FIG. 1 and as indicated by arrow A in FIG. 5). This is accomplished by providing a flexible indicia web 60 having the numerals zero through nine printed thereon with the end of the web mounted on a suitable roll or spindle 62 for rotation about the longitudinal axis 63, defined by the drive shaft 54.

The ends of each web are mounted on and carried by one of the plurality of spindles or web rolls 62, as shown in FIG. 5. In the specific embodiment shown (see FIGS. 2 and 4), web 60 associated with window 34 is mounted on spindles 62 and 76. The web 78 associated with window 33 is mounted on spindles 80 and 82. The web 92 associated with window 31 is mounted on spindles 96 and 100. The web 93 associated with window 30 is mounted on spindles 101 and 103. The web 90 associated with window 28 is mounted on spindles 94 and 98. The web 91 associated with window 27 is mounted on spindles 105 and 107. Horizontally aligned spindles are activated by activating the appropriate clutches by selecting a numbered position on control 26 (FIG. 6). Vertically aligned spindles are rotatable by inserting the crank actuator 24 in the appropriate axially aligned apertures 43, 44, 45, 46.

Figure 4:
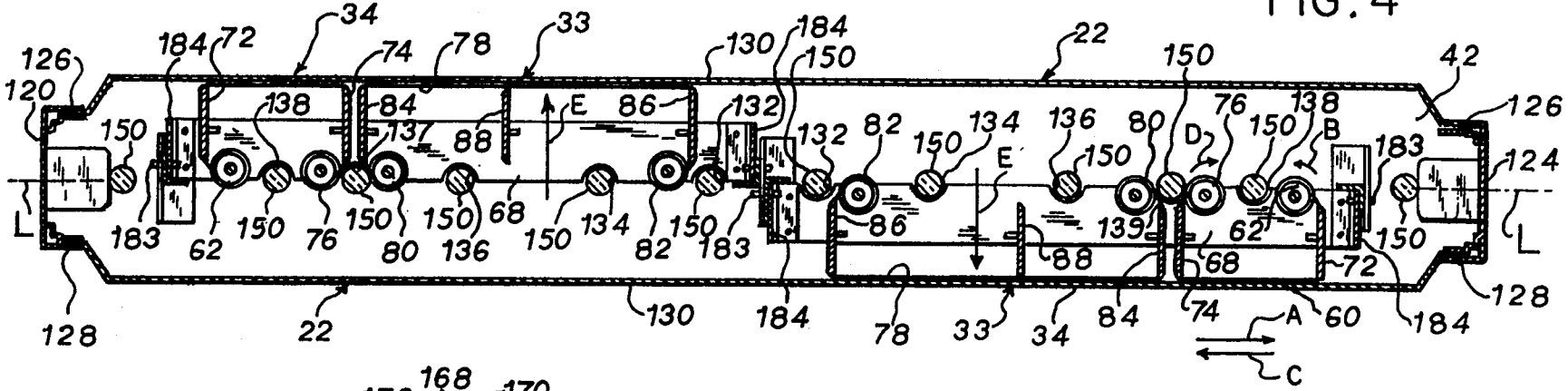
FIG. 4 is a section view taken generally along the line 4—4 of FIG. 2.

For example, switch mechanism position "3" activates the clutches associated with spindles 62, 76, 80 and 82 (FIG. 2) for driving the webs 60 and 78 associated with windows 34 and 33, respectively (FIG. 4). By placing the crank 24 in the aperture 43 (FIGS. 2 and 5), the shaft 54 associated with spindles 62, 96 and 94 is rotated. Since only the clutch associated with spindle 62 of this vertical group is actuated, only spindle 62 is rotated for moving the web in the direction of arrow A (FIG. 5).

As shown in FIG. 5, the drive shaft 54 is coupled at 55 to a segmented shaft 57 passing through the spindles. Each spindle includes a hollow core adapted for receiving the shaft and for housing a one-way clutch mechanism. The drive shaft 57 is in coaxial relationship with the spindle 62. A drive ring 59 is secured to the spindle and rotates therewith. The clutch mechanism 96 includes a low voltage field coil 97, also in coaxial relationship with the drive shaft 57 and secured to the frame member 66 by bracket 99. The power to the coil is provided by leads 101, which are connected to the sign power supply via the control box 26. A rotor 103 is mounted for rotation on the drive shaft.

The clutch mechanism 96 is operative to engage the spindle 62 with the drive shaft 57 for rotating the spindle about its axis when the drive shaft socket 56 is engaged by the turn crank actuator 24. The clutch mechanism operates in the general manner of that described in U.S. Pat. No. 4,741,118 entitled "SIGN WITH IMPROVED SCROLLING MECHANISM" issued to R. Aiken et al on May 3, 1988, incorporated by reference herein. The spindles are coupled to the appropriate shaft by selectively engaging the clutches, which may be electrically operated by the power source for illuminating the sign. In the preferred form, the low voltage field coil 97 is mounted to surround the drive shaft. The rotor 103 is fixed on the shaft in the proximity of the field coil and is magnetized by the coil when energized. When the rotor 103 is magnetized by the field coil 97, an armature is coupled to the face of the rotor to connect the spindle to the drive shaft so that the spindle rotates with the shaft in one direction. The spindle can free wheel in the opposite direction and turning the crank in the opposite direction will not decrease the tension on the web. When the field coil is de-energized, the armature is disengaged from the rotor and the shaft can not drive the spindle in either direction.

In the illustrated embodiment, the clutch is energized by closing a circuit at control 26 for connecting a power supply to the clutch via leads 101 by selectively placing the switch mechanism 38 in the "1", "2" or "3" position. None of the clutches are energized when the switching mechanism is in the off position preventing changing of indicia without access to the switch mechanism. In the preferred embodiment, the clutch mechanism is designed to fit within the spindle providing a compact design for eliminating or minimizing shadows on the sign face.

To provide a drag or retarding brake action on each spindle such as, by way of example, spindle 62 so as to maintain a constant tension on the web 60, as shown in FIG. 5, differential braking means are provided. The differential braking means may be that described in U.S. Pat. No. 4,741,118. A spring 110 is provided in communication with the end of the spindle 62. The spring includes a post 112 which is received in an aperture 114 in the frame member 68. Web 60 is maintained in a taut condition by spring 110 as it is scrolled between spindles.

As can be seen in FIG. 5, a similar spring 116 and post 118 is provided for the spindle 96 for web 90, in vertical alignment with the spindle 62. Each of the spindles of the sign mechanism of the preferred embodiment include a one-way clutch operative in the manner described and a differential brake as shown and described in FIG. 5. In operation, when the switch mechanism is in a selected position, all of the clutches associated with one horizontal array of webs are energized. For example, the clutches from spindles 62, 76, 80 and 82 are energized when the switch mechanism is in position "1". The crank is then placed in one of the drive apertures, for example, aperture 43 for engaging shafts 55 and 57. When the crank is turned, the engaged clutch is operative to drive spindle 62 for advancing web 60 in the direction of arrow A. Turning the crank in the opposite direction causes the clutch to free wheel and prevents decreasing the tension on the web. The clutch in association with spindle 76, although energized, free wheels in this direction. The clutches associated with spindles 80 and 82, although energized, are idle. The remaining clutches, associated with positions "2" and "3" on the control, are not energized. Thus, only clutch 96 associated with shaft 57 and spindle 62 is active during this mode.

In order to scroll the web 60 in the opposite direction, the crank is placed in aperture 44, wherein the clutch associated with spindle 76 is active and clutch 96 free wheels. Thus, when the switch mechanism in control 26 is moved to position "1", the clutches associated with spindles 62, 76, 80 and 82 are energized, whereby placement of the hand crank actuator 24 in any of the apertures 43, 44, 45 or 46 will selectively scroll one or the other of the webs associated with the spindles in the preselected forward or reverse direction.

Likewise, if the switch mechanism is moved to position "2" the clutches associated with spindles 62, 76, 80 and 82 are de-energized, and the clutches associated with spindles 96, 100, 101 and 103 are energized. Turning of the hand crank actuator will now rotate either web 30 or 31, depending on the selected aperture. It follows that when position "3" of control 26 is selected, webs 27 and 28 may be rotated while the remaining webs stay in a stationary position. When the switch mechanism is placed in the OFF position in the control 26, none of the clutches are energized and the webs will not be advanced even if the hand crank actuator 24 is placed in one of the apertures 43, 44, 45 or 46 and in driving engagement with the drive shaft 54.

As is best shown in FIG. 4, the hollow spindle 62 through which the engageable drive shaft passes is adapted for receiving one end of the flexible web 60. Mounted on the brace 68 is an upstanding guide 72 for guiding the scroll 60 outwardly from the spindle to the window area 34. At the opposite edge of the window 34, a second guide 74 is provided, whereby the web 60 rides over the guides 72, 74 in a path extending between spindles 62 and 76. Spindle 76 is rotatable about its longitudinal central axis and is adapted for receiving the opposite end of the web 60.

Also as best shown in FIG. 4, when the drive shaft associated with the spindle 62 is rotated in the clockwise direction of arrow B, web 60 will scroll through the window in the direction of arrow A. The spindle 76 is coaxial with the drive shaft 77 (FIG. 2) associated with the journaled aperture 44. In order to scroll the web 60 past the window in the direction of arrow C (FIG. 4 right hand end), the crank 24 is inserted in the aperture 44 (FIG. 2) and in driving engagement with the drive shaft 77 for rotating the spindle 76 in the clockwise direction of arrow D (FIG. 4). In this manner, the flexible web 60 may be scrolled past the window 34 in either direction for properly adjusting the "cents" figure of the price for the product panel 22.

The "dollars" and "ten cents" price indicia associated with the product panel 22 are likewise provided on a flexible web 78 which is movable past the window 33 of the sign, see FIG. 4. The spindle 80 is rotatable about its longitudinal axis and is adapted for receiving one end of the web 78. The spindle 82 is adapted for receiving the opposite end of the web 78 and is rotatable about its longitudinal axis for advancing the web 78 past the window 33 in the opposite direction. The spindles 80 and 82 are mounted for rotation in the horizontal cross braces 66 and 68 (FIG. 2) in the same manner as the spindles 62 and 76.

A guide plate 84 is provided adjacent to spindle 80 and a guide plate 86 is provided adjacent to spindle 82, each secured on the cross braces 66 and 68 for guiding and controlling the position of the scroll 78 as it is scrolled in front of window 33. Where desired, an intermediate guide plate 88 may be provided to assure that the portion of the scroll 78 which is exposed by the window portion 33 is kept in a taut, planar condition to enhance the aesthetic appearance of the sign. In the preferred embodiment, each of the guide plates 72, 74, 84, 86 and 88 are mounted between the cross braces 66 and 68 (see FIG. 2). The guide plates may be formed of transparent or translucent plastic or metal with cut-outs to prevent shadows on the face. Typically, the guide plates are movable relative to the cross braces 66 and 68 for adjusting the track of the webs between the spindles. This may be accomplished by spreader bars such as bars 256 and 258 shown in FIG. 12.

Figure 3:
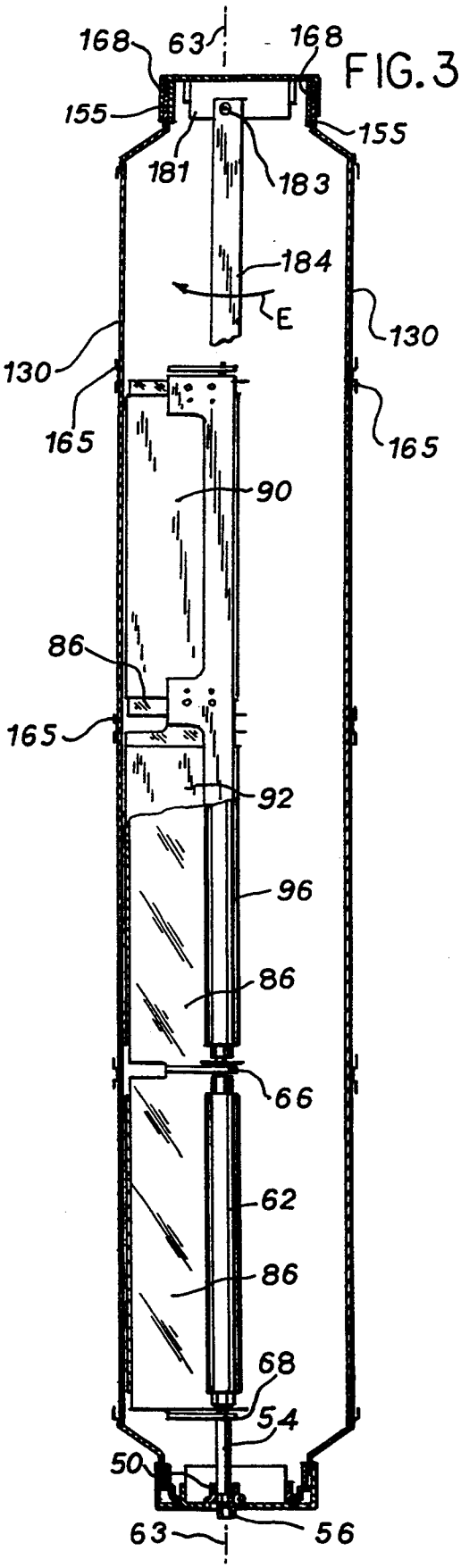
FIG. 3 is a section view taken generally along the line 3—3 of FIG. 2.

With specific reference to FIGS. 2, 3 and 5, it will be noted that the web 90 for the "cents" panel of the product indicia panel 20 and the web 92 for the "cents" panel of the product panel 21 are in vertical alignment with the web 60. The spindles associated with the webs 90 and 92 are in vertical alignment with the spindles 62 and 76 for supporting the web 60. Specifically, the right hand spindle 94 for web 90 is in vertical alignment with the right hand spindle 96 for web 92 and the right hand spindle 62 for web 60. All three spindles may be driven by the drive shaft 54 associated with the crank aperture 43. Likewise, the left hand spindle 98 for web 90 and the left hand spindle 100 for web 92 is in alignment with the left hand spindle 76 for web 60 and all may be driven by the drive shaft 77 in association with the crank aperture 44.

In the preferred embodiment, the spindles 96, 100, 101 and 103 are mounted for rotation between the cross brace 66 and the cross brace 104, and the spindles 94, 96, 105 and 107 are mounted for rotation between cross braces 106 and 104 (see FIG. 2).

While the preferred embodiment is described with an electric clutch such as that shown in the aforementioned U.S. Pat. No. 4,741,118 operated by a control 26, it will be readily understood by those who are skilled in the art that any clutching mechanism for selectively engaging any one of the three vertically aligned spindles would be readily adaptable for use in accordance with the subject invention.

In the preferred embodiment of the invention, the sign 12 is adapted to be viewed from either the front or back, as is best shown in FIGS. 3 and 4. As there shown, the cabinet of the sign includes outer sidewalls 120 and 124, each having a pair of opposed channels 126 and 128 integrally formed on the edges thereof and adapted for receiving a translucent sign face defined by cover panel 130. Each translucent cover panel 130 includes the various indicia windows 27–35, the product indicia panels 20, 21 and 22 and the information indicia panel 18. When the front/back display is used, all of the clutches associated with horizontally aligned webs are energized in a single switch mechanism position.

It will be noted that the structure for supporting the webs is duplicated on both sides of the sign, with identical window indicia panels visible from both sides of the sign. As is best shown in FIG. 4, the front and back edges of the various web support cross-braces 66, 68, 100 and 104 have a plurality of arcuate clearance channels 132, 134, 135, 136, 137 and 138 therein. These channels provide clearance openings for the fluorescent light tubes 150 which are utilized for backlighting the sign. For a sign arranged as shown in FIGS. 1 and 4, in which the webs are vertically stacked, each of the fluorescent tubes 150 may be vertically mounted and located along the center line "L" of the sign. As shown in FIG. 2, each of the fluorescent tubes has opposite ends mounted in a receptive sockets 152 and 154 mounted on the upper and lower framework of the sign, in the well known manner.

It should be noted that the fluorescent tubes 150 are not evenly spaced within the signboard but are disposed in such a manner as to minimize the shadow effect created by the structure within the sign to provide an even backlighted illumination of the various indicia panels. For best backlight effects and to minimize any shadowing caused by the mechanism, the tubes are preferrably mounted parallel to the axes of the web support spindles.

Figure 7:
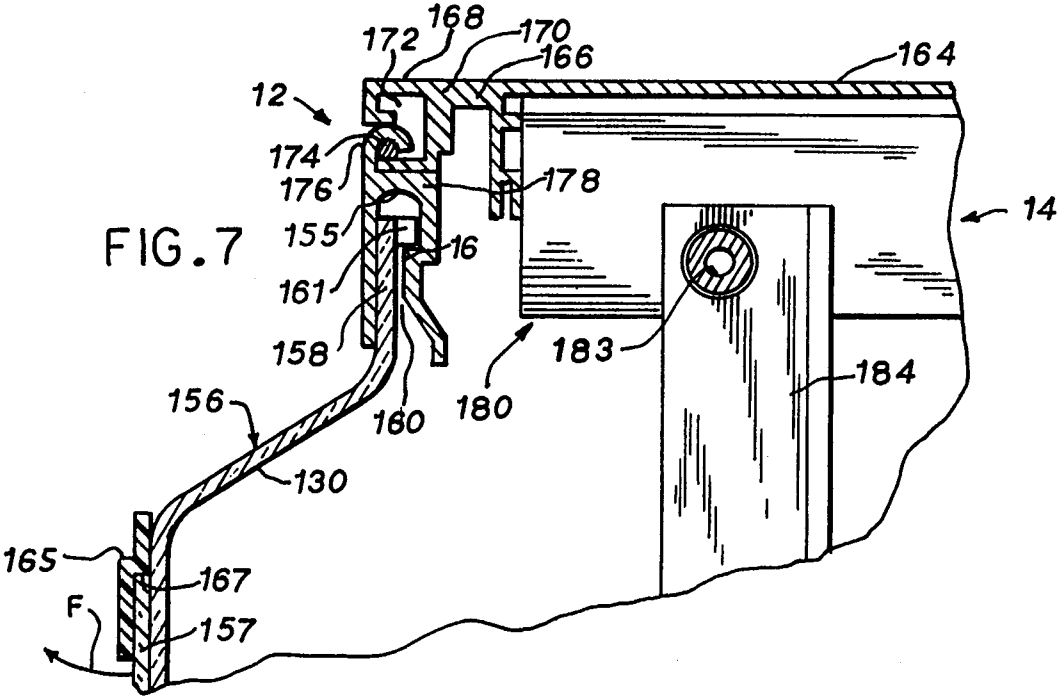
FIG. 7 is an enlarged fragmentary view looking generally in the same direction as FIG. 3.

With reference to FIG. 7, the translucent face panels 130 are lodged in a receptive U-shaped channel in bracket 155. Channel member 155 is pivotally mounted on the top of the sign framework in a manner hereinafter described. This permits the sign face panel 130 to be pivoted outwardly from the frame 14, providing access to the scrolling mechanisms and the light tubes.

As shown, the cover panel 130 includes a beveled edge 156 which terminates in an outwardly projecting edge or rim 158 which is adapted to be seated in the channels 160 defined by the bracket 155 (FIG. 7). Preferrably, panel 130 is secured in channel 160 by a hanging bar 161 that extends along a portion of the length of panel 130. Hanging bar 161 abuts lip 163 of channel 160 to retain the panel in bracket 155. The sides and bottom of panel 130 may be joined to respective framing members in a similar manner.

The upper wall 164 of the sign framework includes an elongate hinge bracket or plate 168. The hinge bracket 168 includes a hinge mounting channel 172 having an elongate hinge pin 174 which extends the length of the front of the sign. The bracket 155 includes an upstanding, generally C-shaped member 176 which is adapted to receive the hinge rod or pin 174. The lower surface of the hinge channel 172 is adapted to receive and abut against the flat surface 178 of the bracket 155, normally holding the bracket in the position shown in FIG. 7, with the front face of the cover panel 130 in a substantially vertical position.

When it becomes necessary to provide maintenance on the interior mechanism of the sign such as, by way of example, the replacement of fluorescent tubes, the face panel 130 may be swung outwardly in the direction of arrow F, and held with a prop rod or other suitable means for exposing the interior of the sign.

As seen in FIGS. 4 and 7, the scrolling mechanism is supported on an internal framework which, in the preferred embodiment, is carried by a pair of vertical struts 184 suspended from the top horizontal cross brace 181 of the sign frame (also see FIG. 3). In the preferred embodiment, the struts are pivotally mounted to the cross brace 181 by the pin 183 (see FIGS. 3 and 7).

As is shown in FIG. 2, the vertical struts 184 support the cross braces 90, 104, 66 and 68 in which the various spindles are mounted. As is better shown in FIG. 5, a slip coupling 55 is provided between the journaled drive shaft 54 and the segmented section 57 which passes through the central core of the various spindles. This arrangement permits the entire scrolling mechanism to be pivoted outwardly in order to provide easy access to the entire mechanism for servicing and maintenance. The slip coupling 55 permits the segmented portion 57 of the drive shaft to slide into and out of engagement with the journaled portion 54 of the drive shaft during the pivoting action. Pin **54*b* provides the same feature with respect to the body of the invention shown in FIG. 15. As with the face cover 130, the scrolling mechanism as supported by the struts 184 is pivotably outward in the direction of arrow E (FIGS. 3 and 7). This permits the mechanism to be pivoted away from the illuminating light tubes 150 without first requiring removal of the tubes (see FIG. 4). As shown in FIG. 4, the left half of the sign includes a scrolling mechanism framework mounted on pins 183 and adapted to swing upwardly (as drawn). The right half of the sign includes a scrolling mechanism framework also mounted on pins 183** and adapted to swing downwardly (as drawn). This swing-out feature of the scrolling assembly facilitates on-site servicing and maintenance of the sign by providing access without complete removal.

As shown in FIGS. 3 and 7, the translucent face panel 130 includes a plurality of elongate strips 165 which are adhesively secured to the front face of the panel 130 and define a channel 167 for receiving translucent panels 157 containing product information and other informational or instructional indicia to be placed in the panels 18, 20, 21 and 22 of the sign. The adhesive channel strips 165 may be made of a semi-rigid plastic or other similar material.

In the preferred embodiment of the invention, the outer members 164, 120 and 124 (FIG. 4) and the lower frame member 42 (FIG. 2) are of a thin walled metal and form a cabinet for sign 12 providing the desired aesthetics of the finished sign. The various structural members such as the formed brackets 166 and the hinge bracket 168 and the cover panel bracket 155 may be made of a formed, extruded metal, reducing the cost of manufacture of the sign.

As is seen in FIG. 4, the structural frame 180 (FIG. 7) is disposed inwardly of the cabinet and provides the support members for the scrolling mechanisms (mounted on struts 184). The upper outer member 164 and the lower frame member 42 also support the ballast and sockets for fluorescent tubes 150.

Figure 8:
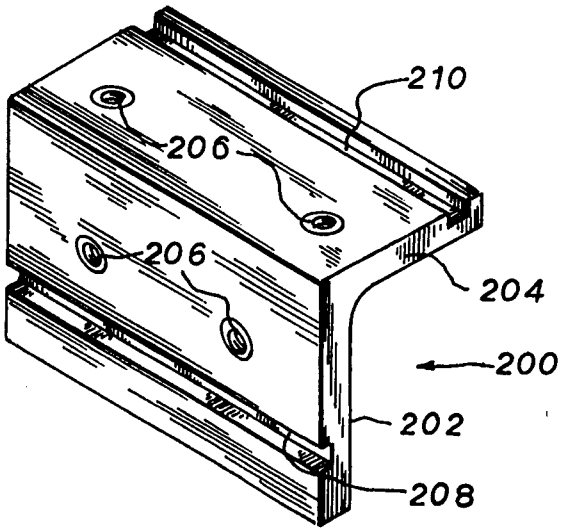
FIG. 8 is a perspective view of an angle bracket for supporting various scrolling frames of the subject invention.

The preferred embodiment of the invention takes advantage of a structural design which permits the use of a minimum number of unique parts. For example, as shown in FIG. 8, all of the corner brackets for supporting the various scrolling support members are identical and in the preferred embodiment are of the configuration of the bracket 200. The bracket 200 is generally L-shaped, and in the preferred embodiment includes a long leg 202 and a short leg 204. A plurality of tapped mounting holes 206 are provided, into which threaded fasteners may be secured for final assembly. There are two elongate channels extending the length of each of the legs, the channel 208 associated with leg 202 and the channel 210 associated with leg 204. The channels 208 and 210 are adapted for receiving alignment pins 212, as shown in FIG. 9. In assembly and as shown in FIGS. 9 and 10, the frame members include enlarged through holes 214 for receiving the various threaded fasteners 216 which are then turned into the tapped holes 206 in the corner brackets. Locator pins 212 positioned in precisely aligned holes 218, provided in the structural framework, are adapted to fit in the channels 208 and 210. By using the locator pin 212 in combination with the threaded fasteners 216, a precision final assembly can be achieved, using common parts and accommodating for tolerance creep.

As shown in FIGS. 9 and 11, the web guides, such as guide plate 86, may be mounted in the cross structural members such as, by way of example, the cross members 66 and 104 (see FIG. 2), by a series of locator pins 220. In the preferred embodiment, the pins are in precision locator holes 222 in the cross members and receptive holes 224 in the guide plates, permitting adjustment of the plates in the direction of arrow F for adjusting the position of the web relative to the respective window. Again, by using the pins in combination with fasteners, the various parts can be aligned and adjusted for tolerance, reducing the overall expense of manufacturing the signboards, yet providing a precise final assembly. However, it will be understood that other materials could be used as long as good, even lighting of the sign is not impaired.

Figure 12:
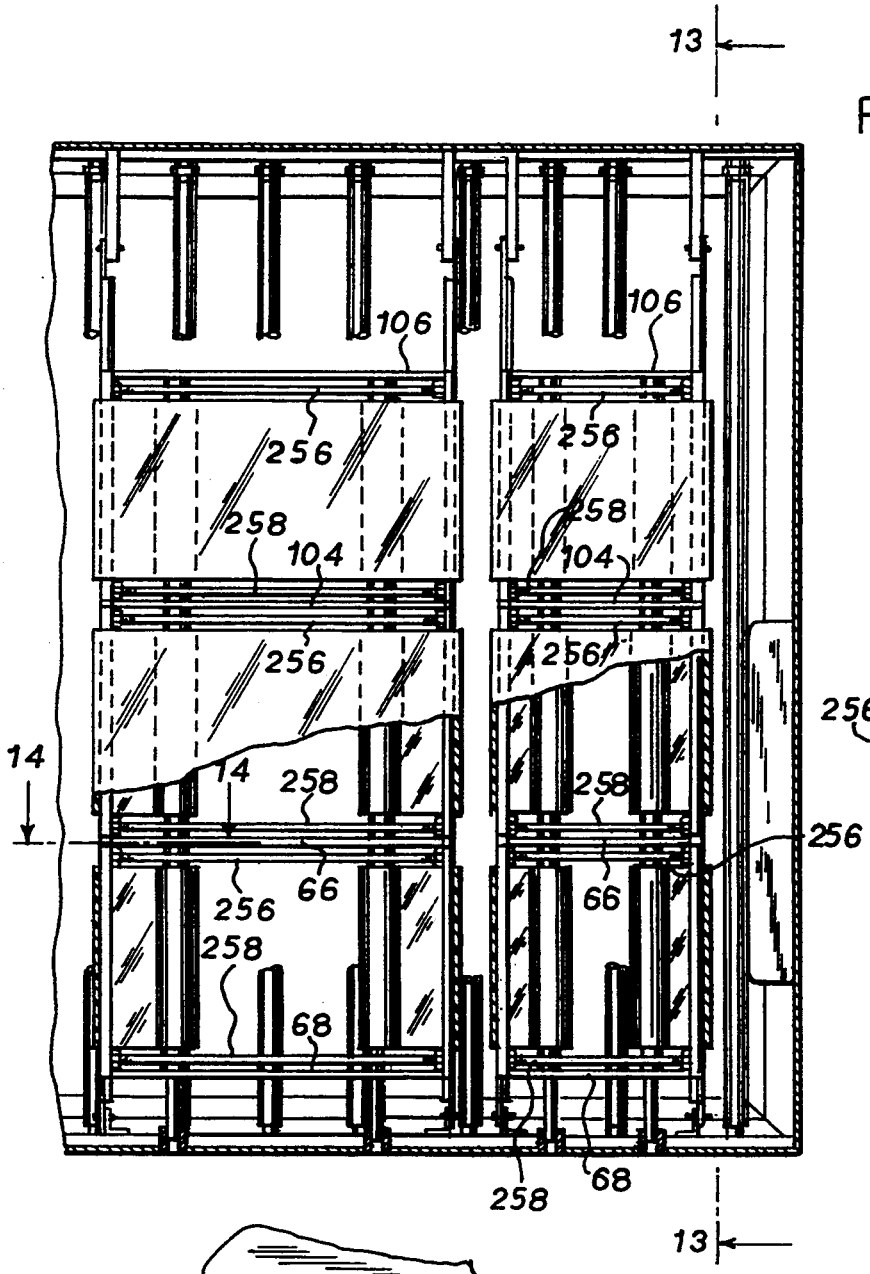
FIG. 12 is a front elevation of an alternative embodiment of the sign, with webs partially removed for clarity.
Figure 13:
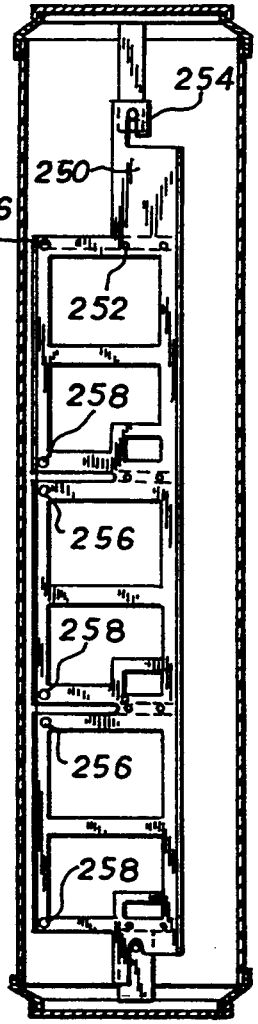
FIG. 13 is a side view of the sign taken along the line 13—13 of FIG. 12.
Figure 14:
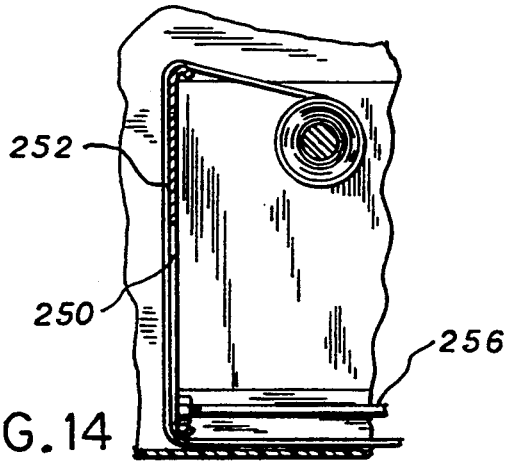
FIG. 14 is a fragmentary view taken along the line 14—14 of FIG. 12.

An alternative structural framework for sign 12 is shown in FIGS. 12, 13, and 14.

In general, the embodiment of FIGS. 12, 13 and 14 combines the web guides and side support members into a single piece, plate 250. The braces 66, 68, 104 and 106 fit in extruded slots in plates 250 into which self tapping fasteners 252 are inserted to fasten the combination web guide and side support plates to the braces. Hooks 254 at the top of the plates provide a pivot for swinging the structural framework module out for lamp replacement and easy removal to work on each module if needed. Material for combined web guide and side support may be a light gauge metal for easy forming, small hole punching, strength and weight reduction. The plates have portions removed to insure even illumination. Or, the plates may preferrably be made of a translucent material, such as plastic to also insure even illumination. Material for the braces may be extruded metal to form same without drilling or machining. As noted above, spreader bars 256 and 258 extend between plates 250 for adjusting the track of the web between the web rolls.

While certain features and embodiments of the invention have been described herein, it will be readily understood that the invention encompasses all enhancements and modifications within the scope and spirit of the following claims.

What is claimed is:

1. A scrolling sign comprising:

a cabinet;

a sign face with a window in which indicia may appear, said sign face being supported by said cabinet and having a frame hingedly secured to said cabinet;

a pair of rotatable web rolls with a web containing serially arranged indicia wound thereon, said web extending along a path between the web rolls and across the window for selectively displaying the indicia in the window; and means for advancing the web past the window, comprising:

a first drive means in driving relationship with one of said rolls, said first drive means adapted for rotating said one roll in a direction maintaining the web in tension for pulling the web past the window in a forward direction;

a second drive means in driving relationship with the other of said rolls, said second drive means adapted for rotating said other roll in a direction maintaining the web in tension for pulling the web past the window in a reverse direction; and a manual actuator selectively engageable with either of said first and second drive means for manually driving and rotating the respective roll for selectively advancing the web in either the forward direction or the reverse direction, said rotatable web rolls and said first and second drive means being supported on a support means pivotally mounted in said cabinet whereby said web rolls and first and second drive means may be pivoted relative to said cabinet, said sign face being adapted to pivot relative to said cabinet independently of said support means.

2. The scrolling sign of claim 1, further comprising illuminating means disposed behind the web for backlighting the web.

3. The scrolling sign of claim 1, further comprising a support structure hingedly mounted on said cabinet for pivotally supporting said sign face, and wherein said sign face is adapted to pivot between a first, closed position in abutting relationship with said cabinet and a second, open position away from said cabinet for exposing said rolls, said web and said first and second drive means.

4. The scrolling sign of claim 1, including a sleeve having a central axis in axial alignment with the respective first and second drive means and wherein each of said first and second drive means includes a drive shaft having an end journaled for rotation in the respective sleeve, the journaled end of each drive shaft including a socket and the manual actuator has a driver adapted to be received in said socket.

5. The scrolling sign of claim 1, further comprising guide means carried in said support means for positioning the web in the window.

6. The scrolling sign of claim 5, wherein the guide means are movable relative to said support means and said window for adjusting the track position of said web relative to said window.

7. The scrolling sign according to claim 6 wherein said guide means comprise plates positioned normal to the path of the web and spaced from each other along the path of the web and wherein said sign includes adjustable spreader bars extending between said plates.

8. The improvement of claim 1, further comprising:

a pair of elongate, spaced apart, channel guides mounted on said sign face adjacent said window; and an elongate, indicia bearing panel adapted to be slidably received in said channel guides.

9. The scrolling sign of claim 1 further including a flexible shaft means for coupling said manual actuator to said first and second drive means.

10. The scrolling sign of claim 1 wherein said frame for said sign face has a channel with a lip, and wherein said sign face has a hanging bar in said channel and engaging said lip for retaining said sign face to said frame.

11. In a sign of the type having a cabinet with rigid side, top and bottom walls, a sign face spanning the cabinet and having a window in which indicia may appear, said sign face being hingedly secured to the cabinet, a pair of rotatable web rolls with a web containing serially arranged indicia wound thereon, said web extending along a path between the web rolls and across the window for selectively displaying the indicia in the window, and illuminating means mounted in said cabinet behind the web and the sign face for backlighting the sign, an improved means for advancing the web past the window, comprising:

a support means mounted in the cabinet between the sign face and the illuminating means for supporting the rolls and web, said support being pivotally mounted in said cabinet and pivotable relative thereto independently of said sign face;

a first drive means in said cabinet and in driving relationship with one of said rolls, said first drive means adapted for rotating said one roll in a direction maintaining the web in tension for pulling the web past the window in a forward direction;

a second drive means in said cabinet and in driving relationship with the other of said rolls, said second drive means adapted for rotating said other roll in a direction maintaining the web in tension for pulling the web past the window in a reverse direction;

each of said first and second drive means including a drive shaft having an end accessible from the exterior of the sign; and a hand crank selectively receivable in each of said drive shaft and having an end adapted for engaging the drive shafts for manually driving and rotating the respective roll for advancing the web in either the forward or the reverse direction.

12. The improvement of claim 11, further comprising guide means mounted on said support means for positioning the web in the window, and means for adjusting said guide means for tracking the position of the webs relative to the window.

13. The improvement according to claim 12 wherein said guide means comprise plates positioned normal to the path of the web and spaced from each other along the path of the web and wherein said sign includes adjustable spreader bars extending between said plates.

14. The improvement according to claim 11 further including a flexible shaft in each of said drive shaft end for coupling said hand crank to said drive shafts.

* * * * *